United States Patent [19]

Schuck

[11] Patent Number: 4,559,786

[45] Date of Patent: Dec. 24, 1985

[54] HIGH PRESSURE HELIUM PUMP FOR LIQUID OR SUPERCRITICAL GAS

[75] Inventor: Thomas W. Schuck, Easton, Pa.

[73] Assignee: Air Products and Chemicals, Inc., Allentown, Pa.

[21] Appl. No.: 578,235

[22] Filed: Feb. 8, 1984

Related U.S. Application Data

[62] Division of Ser. No. 350,914, Feb. 22, 1982, Pat. No. 4,447,195.

[51] Int. Cl.[4] ..... F17C 7/02

[52] U.S. Cl. ..... 62/55; 62/510; 417/901

[58] Field of Search ..... 62/55, 510; 417/901

[56] References Cited

U.S. PATENT DOCUMENTS 2,958,205 11/1960 McConkey ..... 62/55

3,548,846 12/1970 Allen ..... 62/55

3,574,276 4/1971 Strelzoff ..... 62/55

4,156,584 5/1979 Schuck ..... 417/435

*Primary Examiner*—Ronald C. Capossela

*Attorney, Agent, or Firm*—James C. Simmons; E. Eugene Innis

[57] ABSTRACT

A pump for compressing a low temperature high density liquid gas, e.g. liquid helium, wherein the piston is driven by a motor through a four bar linkage which converts rotary motion to reciprocating motion. The pump also includes an improved piston ring assembly, piston venting apparatus and a cushioned discharge valve. A two-stage pump in combination with support equipment provides an improved pumping cycle wherein low temperature density liquid or gas e.g. liquid helium can be withdrawn from a storage reservoir, vaporized and compressed into cylinders.

3 Claims, 7 Drawing Figures

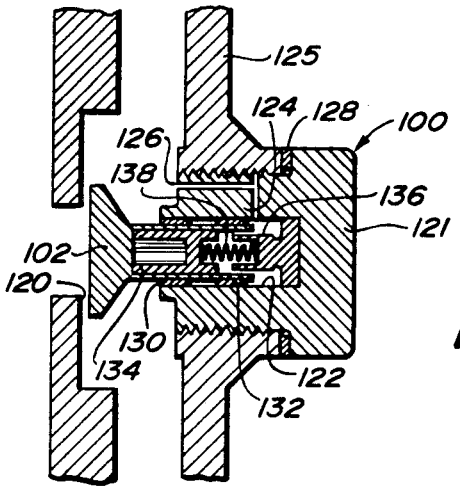
FIG. 6
FIG. 7
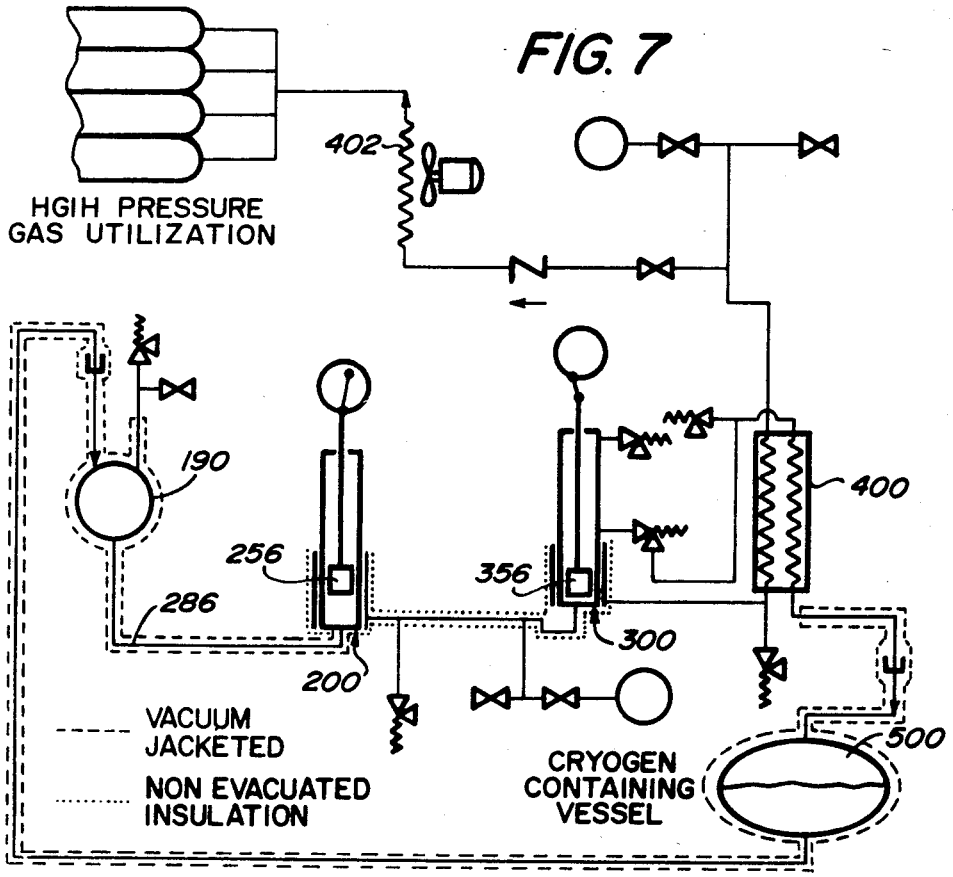

HIGH PRESSURE HELIUM PUMP FOR LIQUID OR SUPERCRITICAL GAS

This is a division of application Ser. No. 350,914, filed Feb. 22, 1982, now U.S. Pat. No. 4,447,195.

TECHNICAL FIELD

The present invention pertains to liquid cryogen pumps and, in particular, to an improved pump for compressing, and transferring liquid and gaseous and supercritical helium.

BACKGROUND OF THE PRIOR ART

Transportation of large quantities of a liquid cryogen, e.g. helium, from the production plant to a distant location is usually accomplished by liquefying the gas, transfering the liquid into an insulated tank, transporting the tank to a distant location where, depending on the final usage, the liquid is either stored as liquid, transferred into another insulated liquid container, or converted to gas, warmed to near ambient temperature, and compressed to high pressure for storage in cylinders. In the case of compression, the process of warming the gas to ambient temperature and then compressing it to high pressure requires; a large capacity heat exchanger and a source of heat (approximately 6700 BTU/thousand standard cubic feet or 1508 Joules/gram), and a compressor containing usually 4 or 5 stages with inter and after stage cooling requiring a driver (approximately 25,500 BTU/thousand standard cubic feet or 5740 Joules/gram), a cooling source (approximately 25,500 BTU/million cubic feet or 5740 Joules/gram), and devices to remove entrained contaminants namely, oil in the form of vapors used to lubricate the compressor.

Capital cost of this equipment is large. Usually incomplete oil removal is not only objectionable but often hazardous since the helium may be used in the diving industry as a breathing gas carrier. Equipment of this size usually is noisy, generally not transportable and requires, inter alia, constant supervision while in operation, continual analysis of compressed helium and frequent maintenance.

U.S. Pat. No. 4,156,584 is one example of a helium pump used to compress and transfer liquefied gas but one that will not in and of itself be able to accomplish the foregoing objectives.

BRIEF SUMMARY OF THE INVENTION

The present invention overcomes the foregoing problems by first achieving a pump for compressing and transferring liquefied gas, e.g. helium, wherein the piston is driven by a motor, the drive mechanism being based upon a four bar linkage wherein rotary motion of the motor or motor driven fly wheel is converted to reciprocating motion to drive the piston in a nearly straight line. The piston is driven with negligible losses due to nonlinearity of the drive, the nonlinearity being almost negligible. The pump further includes an improved piston ring assembly to minimize leakage of the cryogen past the piston, a boot assembly to vent air entrained in the cylinder above the piston head and a cushioned discharge valve to prevent leakage of fluid past the discharge orifice. A two-stage pump in combination with the associated valving and heat exchangers provides mean and methods for removing liquefied helium from a storage receptacle and vaporizing the liquefied helium with pressurization to approximately 3,000 psi (205 atmospheres). The specific energy requirement to perform this compression is approximately 1020 BTU/ thousand standard cubic feet (230 Joules/-gram).

BRIEF DESCRIPTION OF THE DRAWINGS

FIG. 6 is an enlarged fragmentary view of the cushioned discharge valve of the pump of FIG. 3.

FIG. 7 is a schematic representation of a pump according to the invention together with associated equipment used to pump liquid helium.

DETAILED DESCRIPTION OF THE INVENTION

Figure 1:
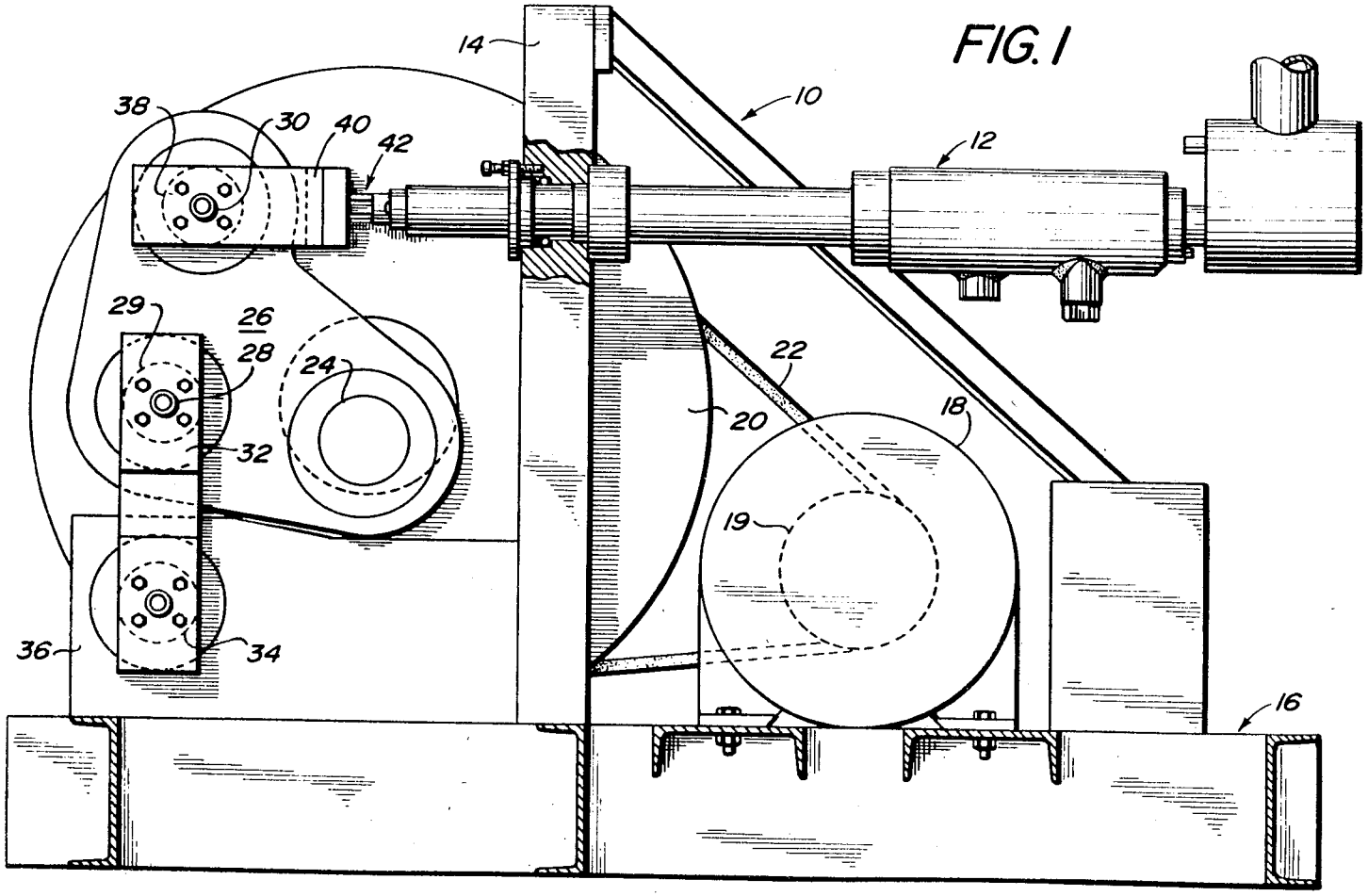
FIG. 1 is a front elevational view of a pump assembly according to the present invention.

Referring to FIG. 1, the pump assembly 10 includes the pump 12 mounted on a base plate 14 which in turn is affixed to a frame 16 constructed of structual members such as channels which may be arranged and secured together by conventional techniques and in a manner to accommodate all the accessory equipment as is well known in the art. A motor 18 is mounted on frame 16. Motor 18 drives fly wheel 20 by means of a flexible belt 22 as is well known in the art, the fly wheel 20 being held to the frame 16 in a conventional manner for rotation. Fly wheel 20 includes an eccentric 24 which in turn has mounted thereon a beam 26 having a generalized shape in the form of a L. The assembly of linkages can resemble a letter J giving rise to calling the drive mechanism a "J-drive". Beam 26 has two points 28, 30, positioned so that the center of eccentric 24, points 28 and 30 define a right triangle with the centers at the apices of the right triangle. Point 28 includes a pivot 29 fixed to rocker arm 32 which is in turn journaled to a pivot 34 fixed to a suitable structural member 36 which in turn is fixed to base plate 14 and frame 16. Point 30 has a pivot 38 which receives yoke assembly 40 which is in turn fixed to the pump shaft (not shown) via a threaded connector 42. The drive mechanism operates so that when the motor rotates, rotary motion of the fly wheel 20 is translated into reciprocating motion of the pump shaft so that the piston inside the pump is driven in a linear reciprocating motion.

The drive mechanism for the piston transmits rotating power from the motor 18 via a pulley 19 and belt 22 to the fly wheel 20. Fly wheel 20 is keyed to crank shaft eccentric 24. Crank shaft eccentric 24 drives the beam 26 through tapered roller bearings (not shown). Zero clearance can be maintained on tapered roller bearings by means of "O" rings (not shown) used as springs. The "O" rings also seal the crank shaft to the seal ring and prevent loss of grease from the bearing cavity. The drive mechanism consists of the beam 26, coupled to the rocker arm 32, pivot support 36 fixed to base plate 14, and the eccentric 24 of the fly wheel crank shaft to form the four bar linkage. Thus, the coupler point curve of the beam 26 at the piston drive end 38 is nearly a straight line.

Figure 2:
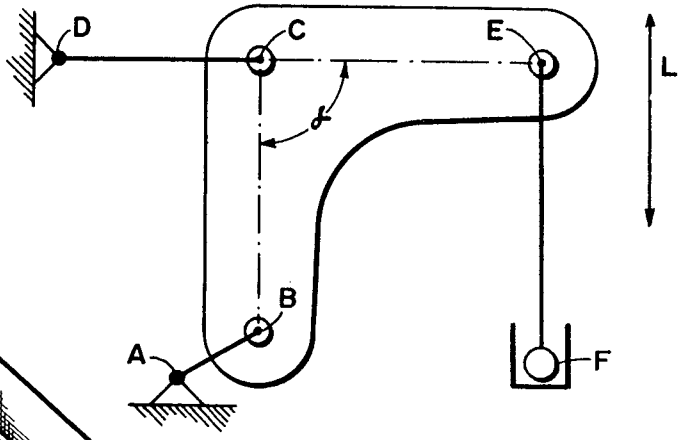
FIG. 2 is a schematic representation of the four bar drive linkage for the pump of the present invention.

Referring to FIG. 2, the four bar linkage is schematically shown which produces nearly true straight line reciprocating motion from continuous rotary motion. The slight deviation from true straight line motion is accommodated by a flexible link which is sized to permit transmission of both compressive and tensile forces. The linkage transmits continuous rotary motion of the crank AB to bar BC of the four bar linkage AB, BC, CD, AD. Bar BC is moved in such fashion by the crank AB and the constraint of bar CD that a point E extended from bar BC exhibits nearly perfect straight line motion. The deviation from a straight line is accommodated by flexure of bar EF, the length of bar EF is not critical to the drive arrangement if a bearing is employed in the piston. The length of EF is made sufficient for flexure when as, in the present invention, there is no bearing in the piston and flexure of the bar EF is used to accommodate movement perpendicular to its direction of motion. Thus, it can be demonstrated that the coupler point curve of extension E in the linkage AB, BC, CD, AD has a deviation from a straight line of plus or minus 0.002075 parts (inches/inch or centimeters/centimeter, etc.) and that an extremely small force perpendicular to the direction of motion of bar EF is imposed on the piston guide even if a rather large force is imposed on bar EF in the direction of its motion.

Prior to the four bar linkage diagramed in FIG. 2 with the dimensions or proportions shown in Table I the closest cataloged approximation to straight line using a four bar linkage was shown to have a deviation of approximately plus or minus 0.0171 parts (inches per inch or centimeters per centimeter, etc.) as illustrated by John A. Hrones and George L. Nelson in their publication entitled "Analysis of the Four-Bar Linkage its Application to the Synthesis of Mechanisms", 1951 published jointly by the Technology Press of the Massachusetts Institute of Technology and Wiley Press, N.Y., N.Y.

TABLE I

| |
|---|
| $AB = \frac{1}{2\sqrt{2}} L$ |
| $BC = 2.0\ L$ |
| $CD = 2.0\ L$ |
| $AD = 2.8173\ L$ |
| $CE = 2.0\ L$ |
| $\alpha = \pi/2$ |
| $EF \geqq L$ |

Specific proportions of the four bar linkage shown in Table I are key to making possible the combination of the four bar linkage and the flexible bar disclosed herein. The combination, in this case, can conveniently handle a load of 8,000 pounds (3,632 kg) applied in the direction of motion of the bar E without buckling the bar, while developing a negligibly small force or movement perpendicular to the direction of motion. In previous reciprocating drives using a four bar linkage and lever a force of 3,000 pounds (1362 kg.) was permissible and the drive was not compact. To achieve similar results with such a drive mechanism a beam length of 30 times the stroke (L) would be required. The drive mechanism of the present invention accomplishes the same end with a beam length 2 times the stroke and a summed length (DC plus CE) of 4 times the stroke.

Figure 3:
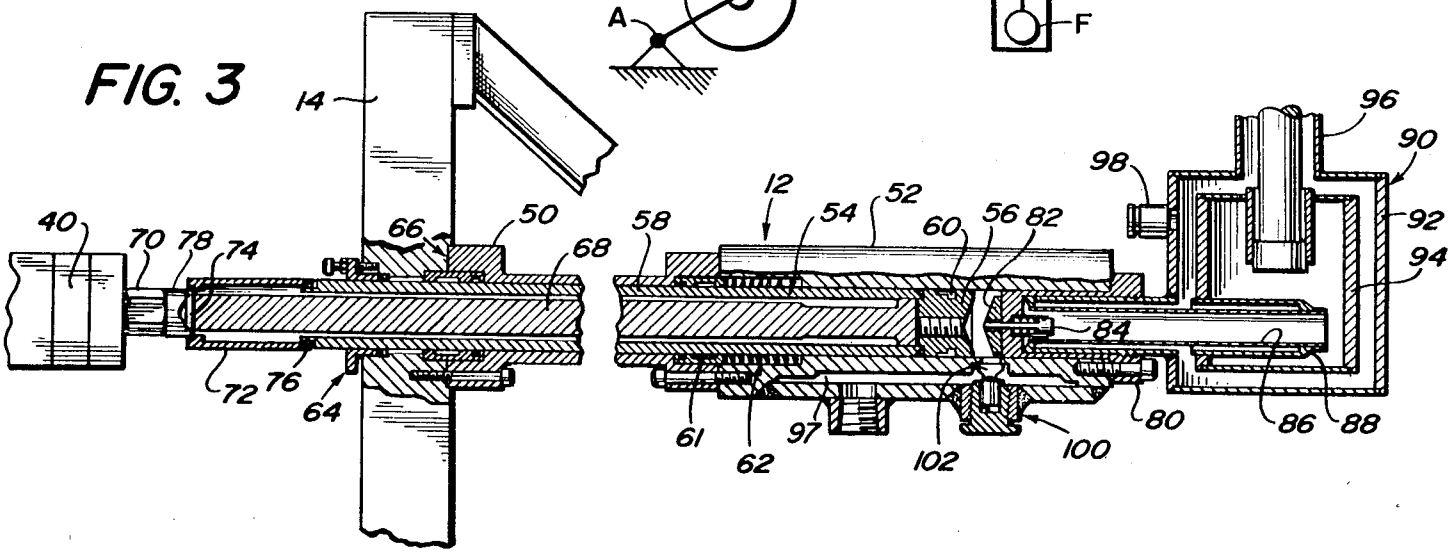
FIG. 3 is an enlarged longitudinal section of the pump of FIG. 1.

Referring now to FIG. 3, the pump 12 is affixed to base plate 14 by a support column 50 which in turn is fixed to cylinder 52. Disposed within cylinder 52 is piston 54 comprising a solid head 56 machined from a bar of chromium nickel stainless steel affixed to an elongated tubular extension 58 also fabricated from chromium nickel stainless steel. Piston 54 reciprocates inside of cylinder 52 and is positioned by a piston rider 60 and sealed by a piston seal or ring assembly 62 which is detailed in FIG. 5 and will be described more particularly hereinafter. Piston 54 is slideably mounted in base plate 14 by means of a rod seal assembly 64 and suitable guiding means 66 as is well known in the art. Disposed within the piston is a piston rod 68 which is affixed to yoke assembly 40 by means of a threaded bolt connection and nut 70 as is well known in the art. The piston is sealed to the piston rod at the drive end by means of a rigid boot 72 and a pair of O rings 74, 76. Between boot 72 and nut 70 is a boot stop 78 illustrated in FIG. 4 and described more fully hereinafter.

Coupled to the cylinder is an inlet valve seat 80 which includes an inlet valve 82 and an attendant inlet valve stem 84. Inlet valve seat 80 has mounted thereon an inlet conduit 86 and nozzle 88 which have affixed thereon a vacuum jacketed accumulator 90. The vacuum jacketed accumulator 90 includes an outer vacuum jacket 92 and an inner product accumulator (surge vessel) 94 and an inlet conduit 96. A pumpout port 98 is included to achieve the required vacuum for the accumulator 90. A discharge valve 100 having a poppet 102 is shown generally in FIG. 3 and detailed in FIG. 6.

Figure 4:
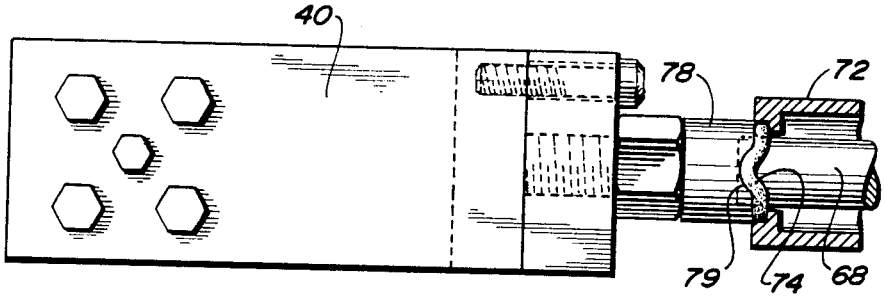
FIG. 4 is an enlarged fragmentary view of the pump of FIG. 3 illustrating the boot stop.

Referring to FIG. 4, the boot stop 78 of FIG. 3 is shown in greater detail. The boot stop 78 includes a groove or recess 79 which forms an indentation on the surface which mates with "O" ring 74 which seals the boot 72 to the piston rod 68. If gas accumulates between the piston rod 68 and the inner surface of piston 54 due to either helium leaking past the threaded joint connecting the piston rod 68 to piston head 56 or air leaking into the space via the boot seals while the apparatus is cold and subsequently expands when warm, "O" ring 74 will deform as shown in FIG. 4, thus creating a passage for the gas to pass outwardly of the boot 72. "O" ring 74 popping out of its cavity acts as a relief valve as shown. As the apparatus cools "O" ring 74 will resume its original shape and provide an effective seal. Boot stop 78 prevents axial motion of the boot relative to the piston rod and piston while permitting torsional motion (wobbling) of boot 72.

Figure 5:
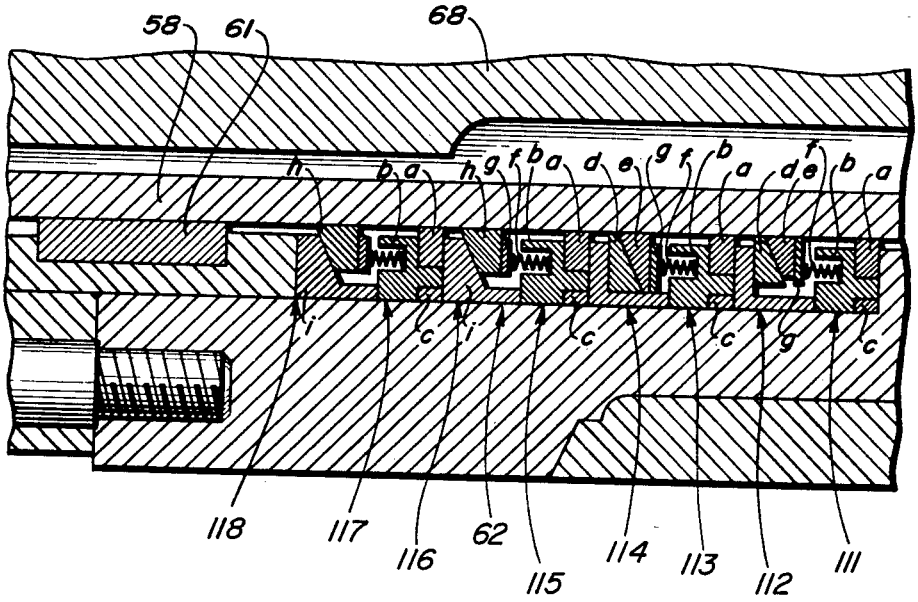
FIG. 5 is a fragmentary section of the pump of FIG. 3 illustrating the piston seal.

Referring to FIG. 5, the piston seal 62 consists of 8 separate assemblies. The first (111), third (113), fifth (115) and seventh (117) assemblies are gas block assemblies comprising an unsplit cylinder ring (a) which reduces the pressure fluctuations on the succeeding rings. Due to the differential thermal contractions of the rings and piston materials the ring becomes tighter on the piston at lower temperatures. The rings (a) are made of compounds of polytetrofluoroethylene and filler materials sold under the trade designations Rulon LD and FOF-30 which exhibit low wear and frictional behavior in unlubricated sliding contact with chromium nickel stainless steel which is used for the piston material. Retainers (b) for the gas block rings are machined from a metal alloy having low expansion characteristics such as sold under the trade designation Invar 36. The retainer is sealed to the cylinder wall by means of static sealing rings (c) which are an unsplit cylindrical ring of polytetrofluoroethylene sold under the trade designation Teflon. Since the cylinder is fabricated from a chromium nickel austenitic stainless steel as the cylinder cools it contracts inwardly in a radial direction. The retainer ring (b) does not undergo as much inward contraction as the cylinder thus compressing the seal rings (a) and preventing leakage past the cylinder wall and retainer. The second (112) and fourth (114) assemblies consist of a beveled upper ring (d) which is unsplit and a split beveled lower ring (e). The function of the split in ring (e) is to allow for wear of the lower ring (e) while the unsplit upper ring (d) seals the area created by the split. The rings are held together by means of springs (f) which exert axial force on a pusher plate (g) and on the rings themselves. The sixth (116) and eighth (118) assemblies are bevelled rings (h) in a beveled retainer (i) and are split in a direction which limits leakage past the split. These rings (h) are split to allow for wear and have proven to have relatively long life with very low leakage. Assemblies six and eight are mechanically the weakest assemblies in the composite piston seal and are, therefore, near the end opposite the pumping chamber where pressure pulsations are the least.

FIG. 6 details the energy dissipating valve cushion or cushioned discharge valve 100. Valve 100 is fixed to pump 12 so that poppet 102 closes a discharge orifice seat 120. Valve 100 includes a valve body 121 comprising a cylindrical bore 122, a cylindrical jacket wall 124, aperture 126 for relieving gas pressure and sealing gasket 128, the valve body 121 being removable from the valve receiver 125 in cylinder 52 by suitable threads as shown. Poppet 102 is guided by a pair of bushings 130, 132 fixed to the body 121. Cushion elements 134, 136 are affixed respectively to the poppet 102 and valve body 121 and have disposed therebetween a spring 138. Cushion members 134, 136 are fabricated in such a manner that they have thin elastic sections which will contact each other on excursion of the poppet valve to the open position. Elastic compression of the thin section of the cushion elements 134, 136 cushions the opening of the poppet valve. Normally, when a check valve is subject to rapid (dynamic) changes in flow (direction or magnitude) the poppet 102 and spring 138 acquire kinetic energy. If the flow increases in magnitude the direction of motion of the poppet will be called opening. If the flow decreases in magnitude or reverses, the poppets direction of motion will be called closing. During periods of steady flow the poppet will (eventually) acquire an equilibrium position where, in the absence of other effects, the fluid resistance forces against its face are balanced by the forces exerted by the spring 138. Check valves used in reciprocating pumps and compressors (both for the inlet and discharge of each cylinder) are subjected to dynamic flow within each cycle. Therefore, the poppet element 120 is in motion during at least part of each cycle. The accelerations and velocities of the poppet are not negligible. Unless the dimensions of the valve are sufficient to provide no limit to the poppet motion, the poppet will, when opening strike the stop 136. When closing the poppet will eventually strike seat 120. The problem is that when the poppet strikes either the stop or the seat it may rebound, and will generally produce forces and stresses on the seat, stop and faces of the poppet. Rebounds from the seat result in a lag between the time at which the valve should close and the time at which the poppet comes to rest in the closed position. This delay results in reverse flow in the reciprocating compression equipment. Should the impact stresses induced in the seat stop, or the poppet be of sufficient magnitude, yielding, deformation and finally fracture of the valve component can result. Thus, the valve of the invention comprises a cushion with no fluid damping requirements, the cushion relying on the elasticity of the cushion materials. It is only active when the valve is nearly fully opened, thus providing for minimized rebound of the poppet valve during the opening portion of the cycle.

Referring back to FIG. 3, the piston rod 68 is a slender beam of sufficient cross-section to prevent buckling of the rod, but relatively weak in bending so that the plus or minus 0.0083 inch (0.22 millimeter) deviation from linear motion develops an insignificantly small bending moment on the piston 54. Piston 54 is guided by guiding means 60, 61 and 66 and moves in reciprocating fashion within cylinder 52. The hollow piston 54 is sealed to the piston rod by means of the rigid boot 72 flexibly sealed to the rod by means of an "O" ring 74 and flexibly sealed to the piston by means of an "O" ring 76. These "O" rings provide low torsional restraint to the boot while preventing entrance of air into the annular space between the piston rod and the boot. As described in connection with FIG. 4, should air enter the annular space it will be vented on warming by the action of "O" ring 74 moving into the groove 79 in boot stop 78.

In operation the vacuum jacketed inlet accumulator 90 is connected to a liquid helium tanker containing product (either liquid or cold supercritical gas) at a pressure of 1 to 125 psig (1.07 to 9.5 atmospheres) by means of a vacuum jacketed conduit or transfer line (not shown). Fluid is admitted through valve 82 which opens when sufficient difference in pressure exists across the valve 82 to balance the valve spring which otherwise holds the valve closed. When opening, the moving elements of the valve acquire kinetic energy which is largely absorbed by the valve spring and partially absorbed by compression of fluid within the valve guide. Energy absorbed by compression of the fluid is partially dissipated by leakage of fluid past the valve stem guide ring and the valve guide bearings. This damping effect is useful in slowing the valve both as it opens and as it closes. Undamped valves tend to bounce away from the seat more than damped valves, thus delaying the final closing of the valve. The seat of the valve is flat reducing the guidance requirement to achieve a seal thus allowing some further damping kinetic energy in a hydrodynamic squeeze film.

The discharge valve 100 is as shown in FIG. 6, a flat seat valve which is open when pressure forces across the valve face exceed the force is exerted by the spring 138 and pressure forces across the back face of the valve. Some of the discharge valve kinetic energy is stored in the spring 138 but the remainder is stored in the cushion elements 134 and 136. Part of the cushion stored energy is dissipated as internal friction, the remainder forces the valve to rebound from the fully open position. The damping affect relies primarily on the energy lost to internal friction within the cushion. Some of the closing energy of the valve is dissipated by the hydrodynamic squeeze film formed at the flat seat area, some is dissipated in internal friction in the valve face material and seat material, and the remaining undissipated energy causes the valve to bounce or rebound after closing.

Except for the provision for damping valve kinetic energy, both the inlet and discharge valves are conventional spring loaded, stem guided, pressure actuated flat faced check valves.

In order to take liquid, liquid and saturated gas or supercritical helium and raise it to a pressure of 3,000 psig (205 atmospheres) at a flow rate of 30,000 to 60,000 standard cubic feet per hour (39 to 78 g/sec) a two-stage pump is utilized. Both stages of the pump are constructed in an identical manner to the pump shown in the drawing, the system being shown diagramatically in FIG. 7. Of course, the stages are different in that the first stage would be as shown in FIG. 3 and the second stage would be without the vacuum jacketed inlet accumulator (90). A heat exchanger utilizing ambient air fan driven against tubes containing high pressure helium may be used to warm the helium to near ambient temperature. The warmed high pressure helium may be stored in cylinders.

As shown in FIG. 7, fluid which may consist of helium gas at supercritical temperature and pressure but high density, or liquid and saturated gas mixtures enters the vacuum jacketed accumulator 190. As the piston head 256 of the first stage 200 moves away from the inlet valve (top dead center), the pressure of residual fluid in the pumping chamber drops. When the pressure difference across the inlet valve face exceeds the inlet spring force, the inlet valve opens admitting fluid to the pumping chamber from the accumulator 190 through a vacuum insulated conduit 286. At top dead center, the pumping chamber is filled with fluid and the inlet valve closes. As the piston descends the fluid trapped in the pumping chamber is compressed until pressure within the pumping chamber exceeds the pressure of the first stage discharge. The discharge valve now opens admitting compressed fluid to the annular chamber 97 (FIG. 3) surrounding the cylinder. Despite efforts to thermally isolate this cold chamber, some heat addition to the compressed fluid is anticipated which will reduce the density of the discharge fluid. This fluid is then compressed in the second stage 300 which is vertually identical in construction and operation to the first stage 200, the fluid entering the second stage 300 now being supercritical gas. The discharge valve of the first stage is oriented to permit the expulsion of any liquid in the first stage cylinder during its downward stroke. The discharge valve of the second stage is oriented vertically to facilitate assembly of the discharge valve, the result being that first and second stage valves are located at the bottom side of their respective cylinders.

To limit the interstage pressure of the first stage discharge both the first and second stage bores and strokes are made identical. The first stage is then a booster for the second stage and interstage pressure is developed solely from the heat gained to the first stage fluid. Both stages are identical in volumetric capacity however, if only low density super-critical gas is to be compressed, the first stage may be made volumetrically larger than the second stage.

Typically, liquid, liquid and saturated gas or supercritical dense gas enter the accumulator at a composite density of 0.125 to 0.06 grams per cubic centimeter. In one embodiment of the invention the inlet pressure is limited to 125 psig (9.5 atmospheres) or less mechanically. The fluid is compressed in the first stage and heated, partially during the admission to the cylinder, partially during compression, and partially after expulsion from the cylinder. Conditions of the fluid just prior to entering the second stage include an estimated 1,000 watt heat gain from all sources which increase the fluid temperature from about 5.8° Kelvin to about 8.34° Kelvin. Density of the fluid entering the second stage will be equal to the composite density entering the first stage, and interstage pressure will adjust itself according to the amount of heat unavoidably entering the pump fluid in the first stage 200. Fluid entering the second stage may be compressed to a maximum of 3,000 psig (205 atmospheres), depending upon the cylinder back pressure, and expelled to a first heat exchanger 400, and at assumed temperature of 21.1° Kelvin. The first heat exchanger 400 is used to re-cool piston ring, leakage (blow-by) gas from the second stage. This cool blow by gas may be used to maintain pressure on the ullage of liquid containing vessel 500 from which the pump is removing fluid. The pressure of this blow-by gas stream will slightly exceed that of the vessel, but will not exceed 150 psig (11.2 atmospheres).

The mass flow rate of the piston leakage gas is not usually known but generally increases with increasing discharge pressure, and may increase as the piston rings are worn through operation. The objects are to:

(a) not throw away the leakage gas to atmosphere;
(b) maintain or to some extent make up for liquid level declining in the cryogen vessel (500);
(c) not inject impure gas into the cryogen vessel. (This leakage gas is expected to be substantially less contaminated than commercial Grade A cylinder gas (nominally 99.995% pure);
(d) reduce heat transfer to the liquid surface in the cryogen vessel, or generally, to limit the thermal energy returned to the vessel, and
(e) reduce the volume of blow-by gas so that most (or preferably all) of it can be returned to the cryogen vessel (500).

After about 50 hours of operation, the blow-by mass rate appears to be about 1 SCFM (60 SCFH) when the pump discharge pressure is on the order of 2500 psig (171 atm).

The first stage blow-by is negligibly small (much less than ½ SCFM) and this gas is simply vented to atomsphere by a primary and secondary (if required) relief valve.

The discharge gas now enters a second heat exchanger 402 called a fan-ambient vaporizer, where it will receive heat from the atmosphere until it is nearly as warm as ambient temperature. The gas may be stored in cylinders (gas storage) whose back pressure at any time in the filling process will determine the pump discharge pressure. Cooled blow-by gas will drive remaining liquid out of the vessel connected to the pump inlet and, when the process of emptying this vessel has been completed, the residual gas in the vessel will already be warmed to at least 22° K., thus dense vapor recovery techniques will not be necessary prior to returning the vessel for refilling.

The use of a discharge gas thermal shield surrounding each stage (in the annulus surrounding the cylinder) is thermodynamically sound and eliminates the need for a vacuum jacket around the cylinder and a separate accumulator (surge vessel) for the discharge streams of each stage. This is not thermodynamically appropriate for ambient compressor cylinders where the cylinder operates at a higher temperature than ambient. This feature has not been observed on commercial cryogen pumps.

A pump for compressing and transferring liquid, liquid and gaseous and supercritical helium according to a specific embodiment of the present invention will compress 30,000 to 60,000 standard cubic feet per hour (39 to 78 grams/sec.) of helium to a maxium pressure of 3,000 psig (205 atmospheres). The maximum power consumption for such a unit is 25 horsepower including the 5 horsepower fan for the fan ambient vaporizer. An apparatus according to the invention thus yields a maximum compression requirement of 1,700 BTUs per thousand standard cubic feet (383 Joule/gram) and a heating power requirement of 425 BTU per thousand standard cubic feet (196 Joules/gram). Total maximum power consumption is 2,125 BTU per thousand standard cubic feet (478 Joules/gram). An apparatus according to the present invention requires no heat exchanger cooling, no oil vapor removal equipment, and maintenance should be appreciably reduced due to the small size and reduced number of stages used. A unit according to the invention may prove comparable to warm compression systems in noise and supervision but should not require continuous analysis of the compressed gas. A unit according to the present invention can be mounted on a skid and is readily transportable requiring only connection to a 25 kilowatt source of electric power to the liquid containing vessel and to the cylinders to be filled.

Having thus described my invention, what is desired to be secured by Letters Patent of the United States is set forth in the appended claims.

What I claim is:

1. A method for compressing a low temperature high density liquid gas, liquid and saturated gas, liquid helium, or helium gas at supercritical temperature and pressure but high density comprising the steps of:

withdrawing and transferring said fluid from a storage receptacle to an accumulator of a first inlet of a two stage compressor;

compressing the fluid in the first stage to a pressure intermediate that of the storage receptacle and the final pressure at which the liquid gas, liquid and saturated gas, liquid helium or helium gas is to be compressed;

transferring the pressurized fluid from the first stage to a second stage permitting warming of the fluid during transfer and compressing said fluid to the pressure required at the point of delivery; and heat exchanging and warming the fluid exiting the second state against ambient atmosphere and discharging said warmed fluid to a point of use.

2. A method according to claim 1 wherein leakage gas from a second stage piston of said second stage of said two stage compressor exchanges heat with compressed fluid exiting said second stage.

3. A method according to claim 1 wherein discharge gas is used to thermally shield said first and second compression stages.

* * * * *